US007156686B1

(12) United States Patent
Sekela et al.

(10) Patent No.: US 7,156,686 B1
(45) Date of Patent: Jan. 2, 2007

(54) INSULATION DISPLACEMENT CONNECTION SPLICE CONNECTOR

(75) Inventors: William Sekela, Aurora, OH (US); Mark Mayer, Sagamore Hills, OH (US); Matthew Mrakovich, Streetsboro, OH (US)

(73) Assignee: Gelcore LLC, Valley View, OH (US)

( * ) Notice: Subject to any disclaimer, the term of this patent is extended or adjusted under 35 U.S.C. 154(b) by 0 days.

(21) Appl. No.: 11/318,744

(22) Filed: Dec. 27, 2005

(51) Int. Cl.
*H01R 4/24* (2006.01)

(52) U.S. Cl. ..... 439/403; 439/404; 439/417

(58) Field of Classification Search ..... 439/403, 439/404, 395, 417, 419, 350, 418
See application file for complete search history.

(56) References Cited

U.S. PATENT DOCUMENTS

| | | | | |
|---|---|---|---|---|
| 671,338 | A | 4/1901 | Halford | |
| 3,115,541 | A | 12/1963 | Hanner et al. | |
| 4,173,035 | A | 10/1979 | Hoyt | |
| 4,419,538 | A | 12/1983 | Hansell, III | |
| 4,631,650 | A | 12/1986 | Ahroni | |
| 4,638,117 | A | 1/1987 | Ney | |
| 4,777,573 | A | 10/1988 | Liao | |
| 4,779,177 | A | 10/1988 | Ahroni | |
| 4,807,098 | A | 2/1989 | Ahroni | |
| 4,813,883 | A | 3/1989 | Staley | |
| 4,815,814 | A | 3/1989 | Ulijasz | |
| 4,855,882 | A | 8/1989 | Boss | |
| 4,899,266 | A | 2/1990 | Ahroni | |
| 4,984,999 | A | 1/1991 | Leake | |
| 5,010,463 | A | 4/1991 | Ross | |
| 5,051,877 | A | 9/1991 | Liao | |
| 5,109,324 | A | 4/1992 | Ahroni | |
| 5,121,310 | A | 6/1992 | Ahroni | |
| 5,141,449 | A | 8/1992 | Tieszen | |
| 5,154,508 | A | 10/1992 | Ahroni | |
| 5,199,899 | A * | 4/1993 | Ittah | 439/403 |
| 5,238,424 | A | 8/1993 | Vindum | |
| 5,330,368 | A | 7/1994 | Tsuruzono | |
| 5,337,225 | A | 8/1994 | Brookman | |
| 5,367,122 | A | 11/1994 | De Olano | |
| 5,498,172 | A * | 3/1996 | Noda | 439/404 |
| 5,526,250 | A | 6/1996 | Ting et al. | |

(Continued)

FOREIGN PATENT DOCUMENTS

WO WO 02/097770 A2 12/2002

*Primary Examiner*—Hien Vu
(74) *Attorney, Agent, or Firm*—Fay, Sharpe, Fagan, Minnich & McKee, LLP

(57) ABSTRACT

A splice connector includes a first IDC terminal, a second IDC terminal, a body receiving the first and second IDC terminals, and a cover connected to the body such that the cover selectively slides with respect to the body in the first linear direction from first position to a second position. The body defines a first seat configured to receive an associated first cable and second seat configured to receive an associated second cable that is to be electrically connected to the associated first cable. The first and second IDC terminals each include a portion that extends into a region adjacent a respective wire seat. The cover is configured to cooperate with the body where a portion of the cover engages a portion of the body at a third position between the first position and the second position such that in the third position movement of the cover with respect to the body in a second direction, which is opposite the first, is inhibited.

13 Claims, 11 Drawing Sheets

U.S. PATENT DOCUMENTS 5,559,681 A 9/1996 Duarte
5,584,567 A 12/1996 Rumpel
5,601,448 A 2/1997 Poon
5,829,865 A 11/1998 Ahroni
5,934,930 A 8/1999 Camps et al.
5,961,342 A * 10/1999 Daoud ..... 439/403
5,967,823 A 10/1999 Tsui
6,017,241 A 1/2000 Komai
6,079,848 A 6/2000 Ahroni
6,095,847 A 8/2000 Lin
6,116,944 A 9/2000 Tseng
6,139,352 A * 10/2000 Daoud ..... 439/404
6,261,119 B1 7/2001 Green
6,290,365 B1 9/2001 Schlesinger
6,367,952 B1 4/2002 Gibboney, Jr.
6,383,013 B1 5/2002 Ghesla et al.
6,478,450 B1 11/2002 Grajcar
6,558,021 B1 5/2003 Wu et al.
6,578,986 B1 6/2003 Swaris et al.
6,660,935 B1 12/2003 Southard et al.
2003/0063463 A1 4/2003 Sloan et al.
2005/0207151 A1 9/2005 Aanegola et al.
2005/0221659 A1 10/2005 Mrakovich et al.

* cited by examiner

INSULATION DISPLACEMENT CONNECTION SPLICE CONNECTOR

BACKGROUND

Splice connectors are used to electrically connect an electrical cable to another electrical cable. For a small sized cable, e.g. AWG20GA or AWG22GA, it is difficult to create a reliable and weatherproof connection between cables. Furthermore, known splice connectors for small cables are typically large and thus can obscure the visual impact of a light engine that is powered by the connected cables.

Known connectors are also difficult to use and install and require extra small parts or special tools for field installation. Also, known splice connectors are not staged to allow for a connection of the splice connection to the accompanying wires prior to complete termination of the wires. Furthermore, known splice connectors require proper placement of the wire inside the connector with respect to the terminals so that the proper terminal connects to the proper wire. Also, known connectors are typically not compatible to connect one cable that has one gage of wire to another cable having another gage of wire.

SUMMARY

A splice connector includes a first IDC terminal, a second IDC terminal, a body receiving the first and second IDC terminals, and a cover connected to the body such that the cover selectively slides with respect to the body in a first linear direction from a first position to a second position. The body defines a first seat configured to receive an associated first cable and second seat configured to receive an associated second cable that is to be electrically connected to the associated first cable. The first and second IDC terminals each include a portion that extends into a region adjacent a respective wire seat. The cover is configured to cooperate with the body where a portion of the cover engages a portion of the body at a third position between the first position and the second position such that in the third position movement of the cover with respect to the body in a second direction, which is opposite the first, is inhibited.

A method for splicing a first cable to a second cable using a splice connector comprising a body, a first cover, a second cover and IDC terminals disposed in the body includes, among others, the following steps: placing the first cable between the first cover and the body adjacent an end of one of the IDC terminals disposed in the body; placing the second cable between the second cover and the body adjacent an end of one of the IDC terminals disposed the body; linearly displacing one of the body and the first cover towards the other into a staged mechanical connection between the body and the first cover that inhibits movement of the first cover away from the body and inhibits axial movement of the first cable with respect to the body; linearly displacing one of the body and the second cover towards the other into a staged mechanical connection between the body and the second cover that inhibits movement of the second cover away from the body and inhibits axial movement of the second cable with respect to the body; further linearly displacing one of the body and the first cover towards the other such that the end of the IDC terminal adjacent the first cable contacts a wire of the first cable; and further linearly displacing one of the body and the second cover towards the other such that the end of the IDC terminal adjacent the second cable contacts a wire of the second cable.

A splice connector for electrically connecting at least two cables includes a non-conductive body, seven electrically conductive members, a first cover attached to the body, and a second cover attached to the body. The body includes a first seat and a second seat. The first seat is configured to receive an associated first insulated cable. The second seat is configured to receive an associated second insulated cable. Each of the associated cables includes a plurality of wires. The first electrically conductive member is disposed in the body and is configured to pierce insulation to contact a first wire of the first associated cable. The second electrically conductive member is disposed in the body and is configured to pierce insulation to contact a second wire of the first associated cable. A third electrically conductive member is disposed in the body and is configured to pierce insulation to contact a third wire of the associated first cable. The fourth electrically conductive member directly contacts the first electrically conductive member and the third electrically conductive member. A fifth electrically conductive member is disposed in the body and is in electrical communication with the first electrically conductive member. The fifth electrically conductive member is configured to pierce insulation to contact a first wire of the associated second cable. A sixth electrically conductive member is disposed in the body and is in electrical communication with the second electrically conductive member. The sixth electrically conductive member is configured to pierce insulation to contact a second wire of the associated second cable. The seventh electrically conductive member is disposed in the body and in electrical communication with the third electrically conductive member. The sixth electrically conductive member is configured to pierce insulation to contact a third wire of the associated second cable. The first cover is slidably attached to the body and moveable selectively cover at least a portion of the first seat the second cover is slidably attached to the body and moveable to selectively cover at least a portion of the second seat.

DETAILED DESCRIPTION

Figure 1:
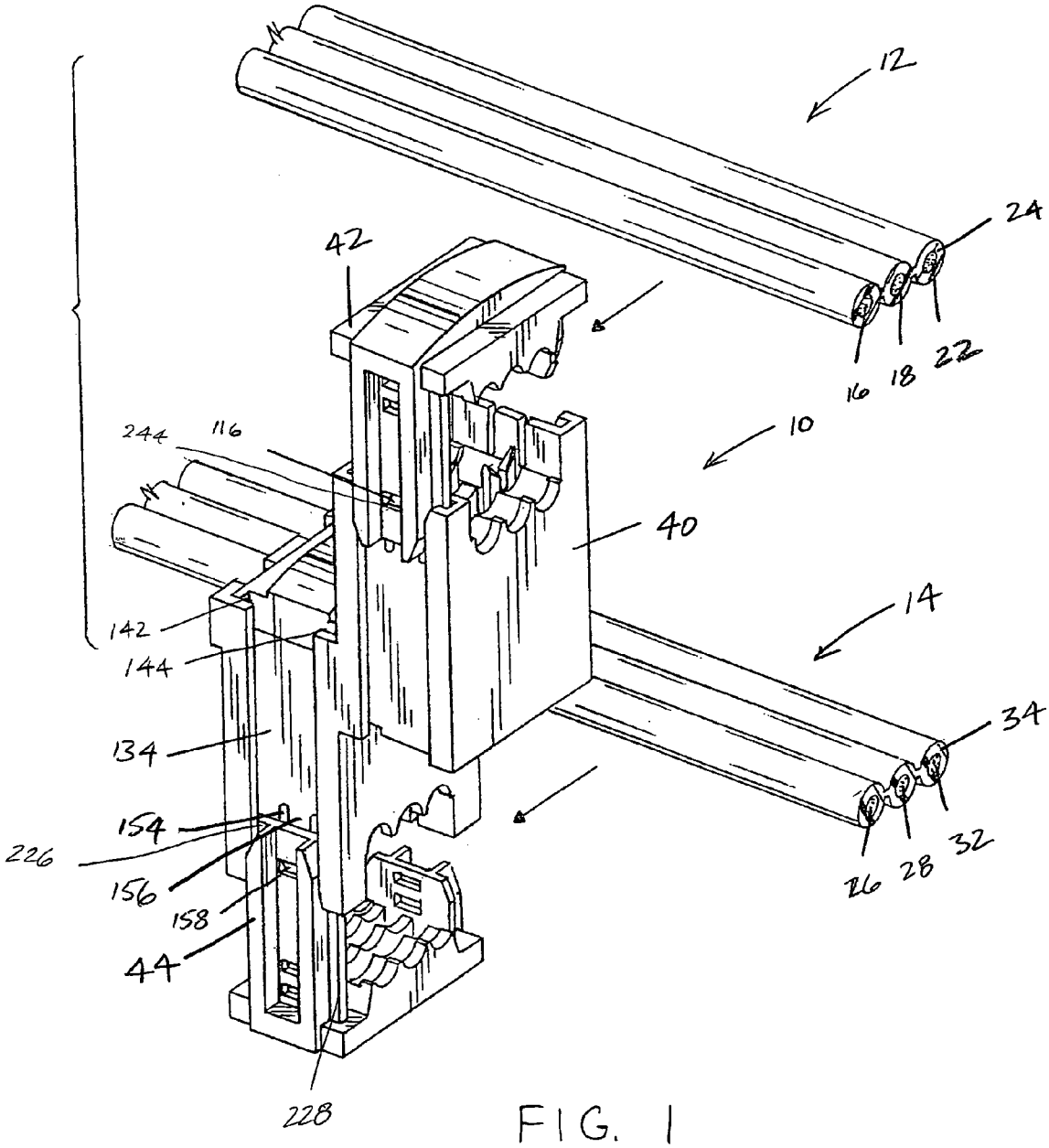
FIG. 1 is a front side perspective view of a splice connector in an open position for receiving two electrical cables to be spliced together.

With reference to FIG. 1, a splice connector 10 is used to mechanically and electrically splice together a first cable 12 to a second cable 14. In the depicted embodiment, each cable includes three conductor wires; however, a fewer or greater number of conductor wires can be provided. In the example depicted in FIG. 1, the first cable 12 includes a positive wire 16, a negative wire 18, and a neutral wire 22. Each of the wires 16, 18 and 22 are surrounded by insulating material 24. Likewise, the second cable 14 includes a negative wire 26, a positive wire 28, and a neutral wire 32, each of which are surrounded by insulating material 34.

Figure 2:
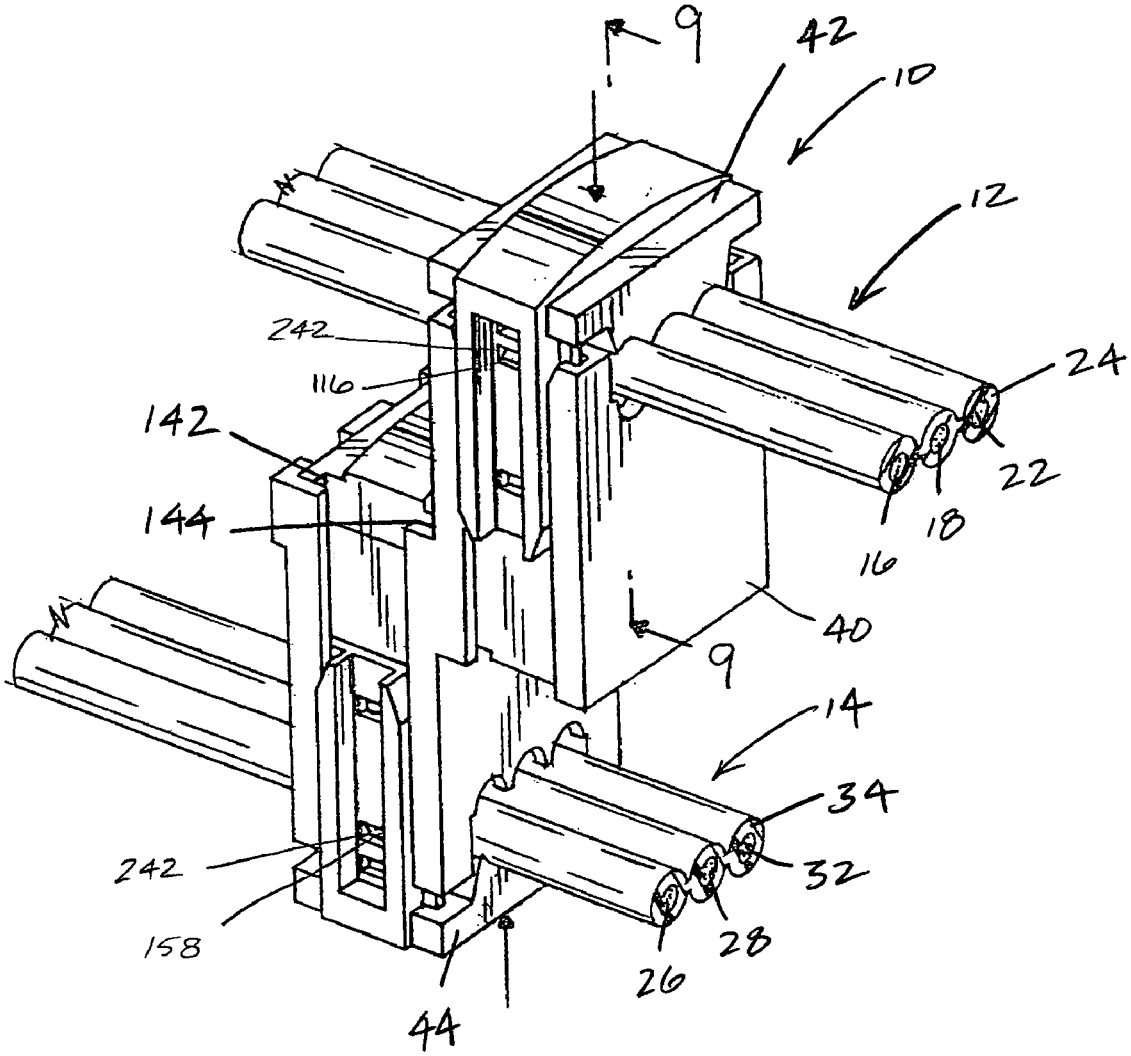
FIG. 2 is a front side perspective view of the splice connector in a staged or partially closed position.
Figure 14:
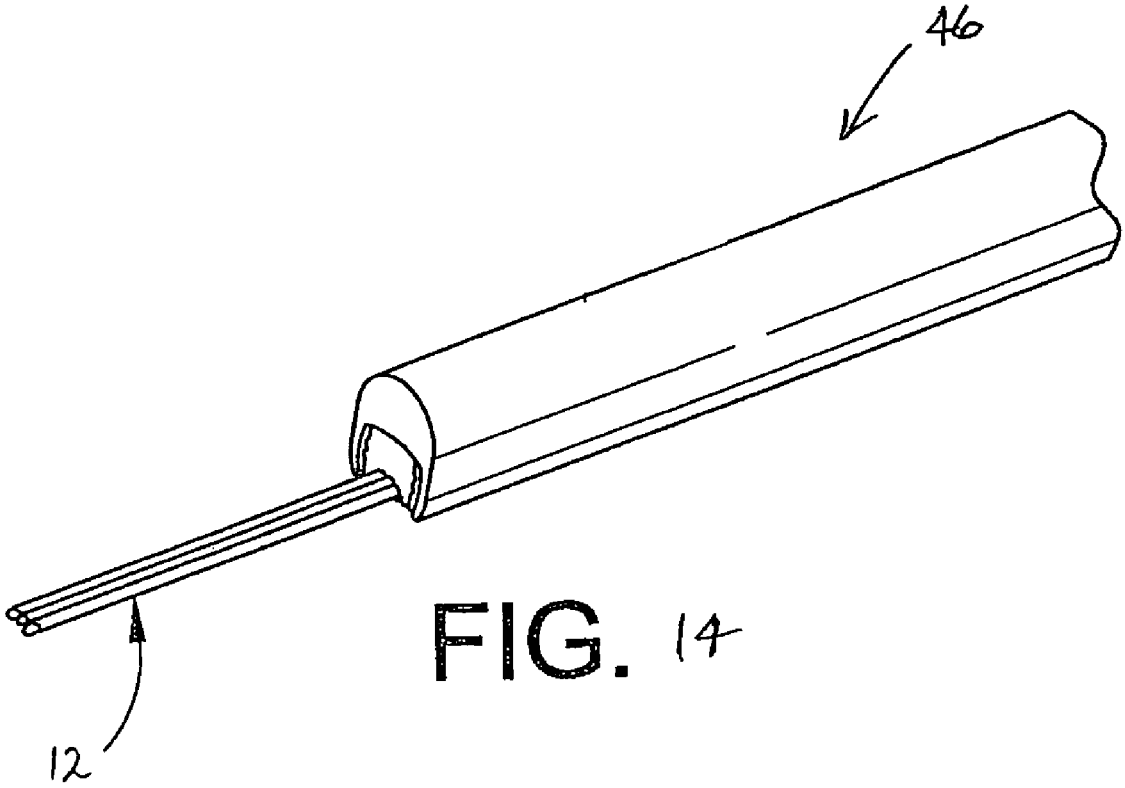
FIG. 14 is a perspective view of a light engine having a cable that can be spliced by the splice connector of FIG. 1.

To splice together the two cables 12 and 14, the cables are inserted into the appropriate location of a connector body 40 as shown by the arrows in FIG. 1. The depicted splice connector 10 is designed to allow the connector to be installed over the cable, e.g. each cable 12 and 14 is inserted in a direction that is generally perpendicular to its length, and the connector is able to slide along, i.e. parallel to the length of the cable. With reference to FIG. 2, after the first wire 12 and the second wire 14 have been appropriately positioned with respect to the connector body 40, a first, or upper, cover 42 is moved linearly toward the first cable 12 to lock into a partially closed position. Similarly, a second, or base, cover 44 is linearly moved towards the second wire 14 so that the base cover 44 is locked into a partially closed position. While in this partially closed position, the installer of the electrical components, e.g. a light engine 46 (FIG. 14), that are electrical communication with the respective cables 12 and 14 can position the electrical components into their desired location. For example, the connector 10 as depicted in the figures can be used to be splice together cables that deliver power to light engines 46 (FIG. 14) that are used as the light engine for channel letter, border lighting, simulated neon lighting, and the like. The partially closed position as shown in FIG. 2 allows the installer to quickly partially close the connector 10 without the need for hand tools, which quickens the overall installation of the electrical components that receive power from the cables 12 and 14. The connector body 40 and the covers 42 and 44 are, in the depicted embodiment, plastic molded (electrically insulative) parts that provide a robust housing for termination of the cables.

Figure 3:
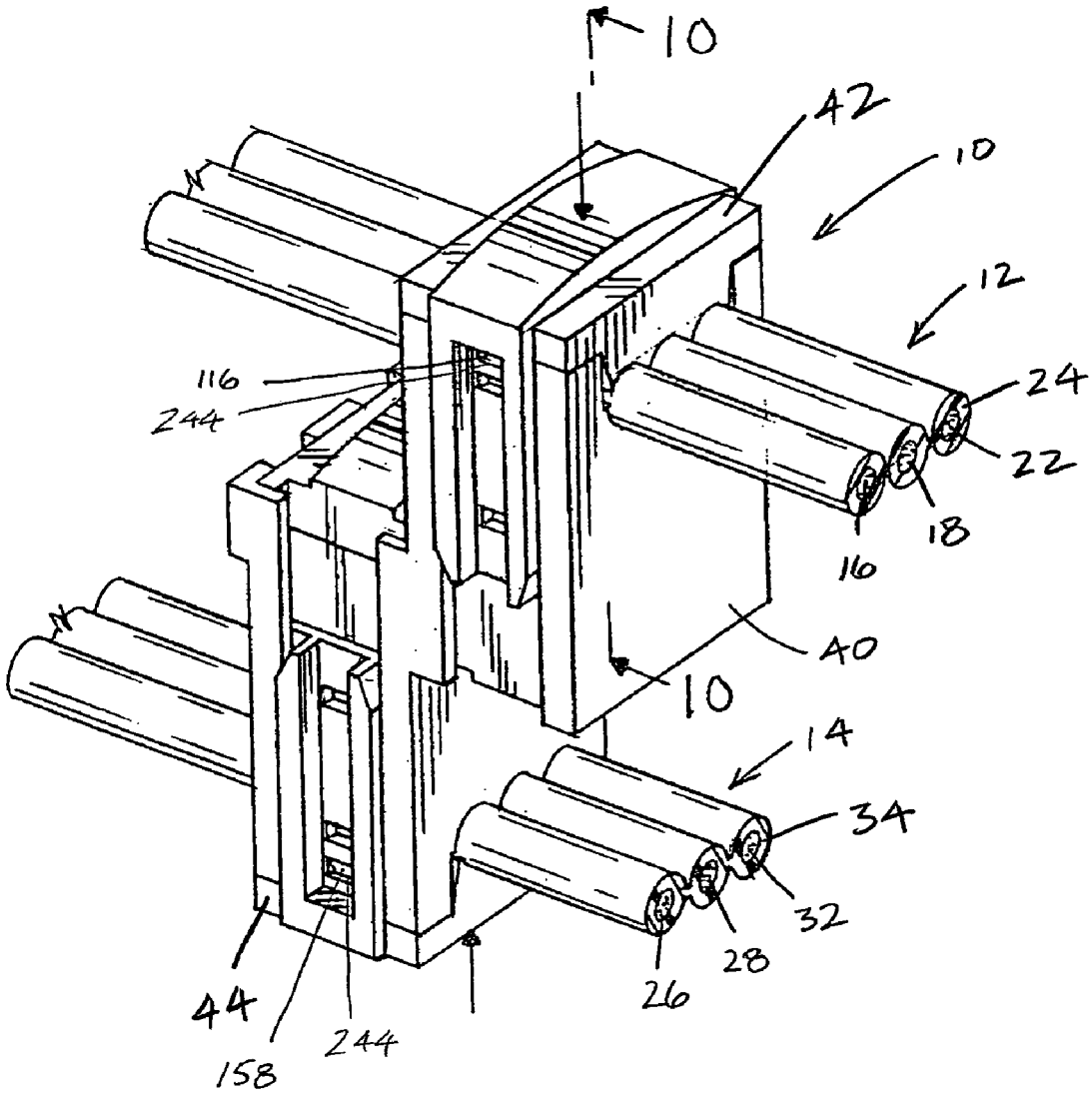
FIG. 3 is a front side perspective view of the splice connector of FIG. 1 in a terminated or closed position.

With reference to FIG. 3, the connector 10 in a fully closed position provides the electrical connection between the wires 16, 18 and 22 of the first cable 12 and the wires 26, 28 and 22 of the second cable 14. To accomplish this, a tool, e.g. pliers, are used to linearly move the upper cover 42 and the base cover 44.

Figure 4:
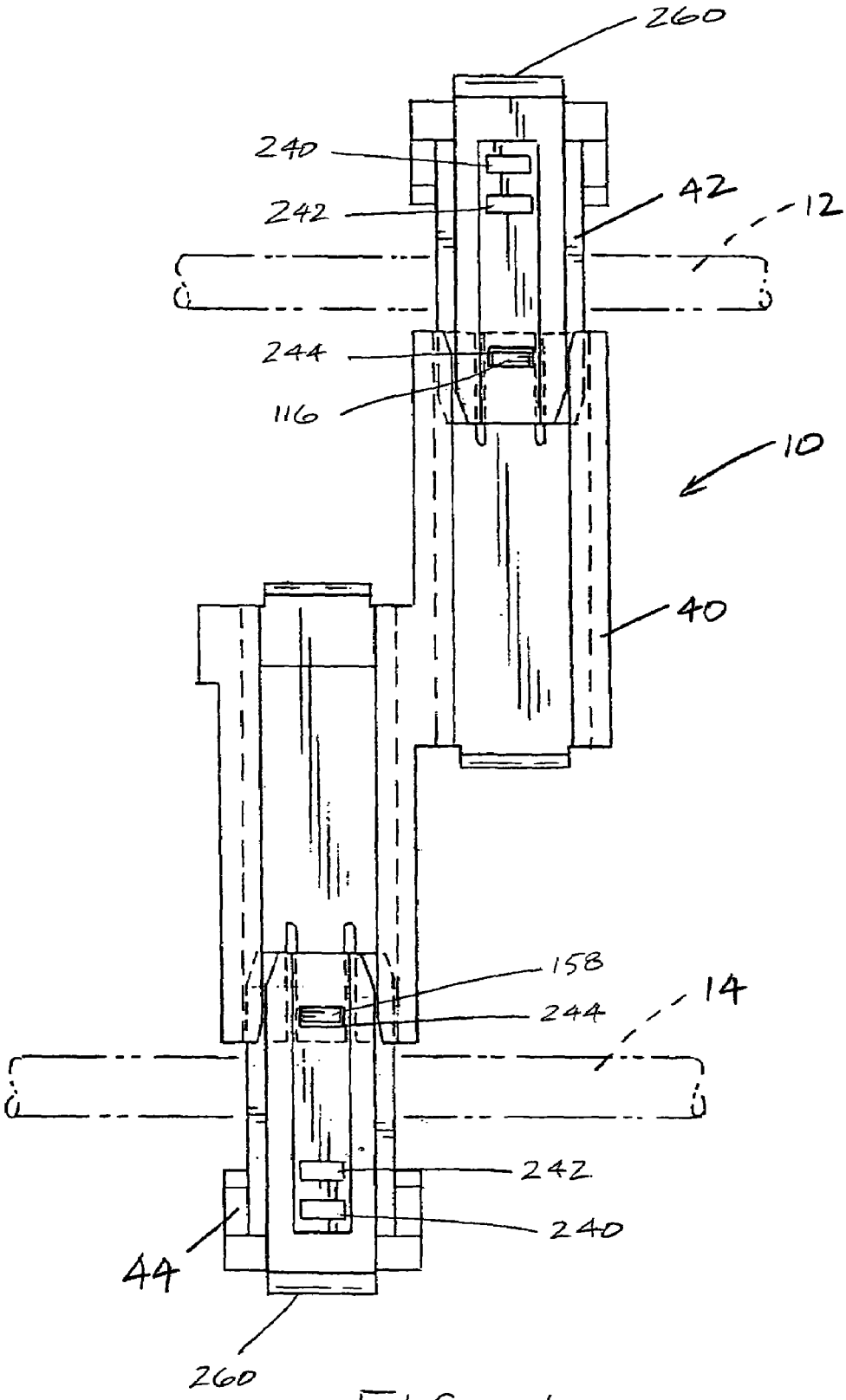
FIG. 4 is a side view of the splice connector of FIG. 1 in the open position.
Figure 5:
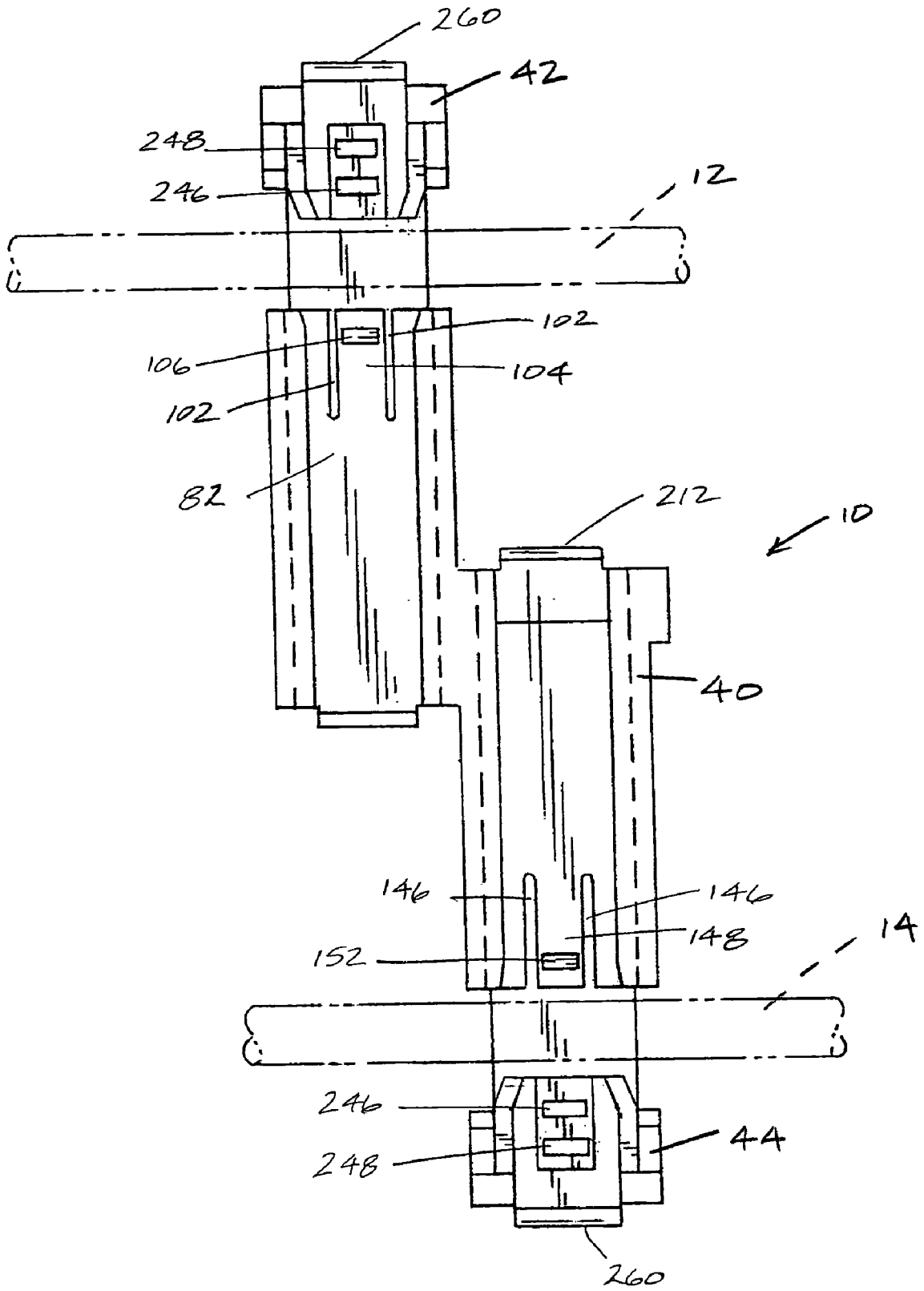
FIG. 5 is a side view, which is opposite the side view of FIG. 4, of the splice connector of FIG. 1 in the open position.

As more clearly seen in FIGS. 4 and 5, both the upper cover 42 and the lower cover 44 selectively move away from the connector body 40 so that the cables 12 and 14 can be easily placed between a portion of the upper cover 42 and the body 40 for cable 12 and between the base cover 44 and the body 40 for the lower cable 14. The cables 12 and 14 are placed into the connector 10 in an insertion direction, that is generally perpendicular to the lengthwise dimension of the cables, which facilitates easy insertion of the cables.

Figure 6:
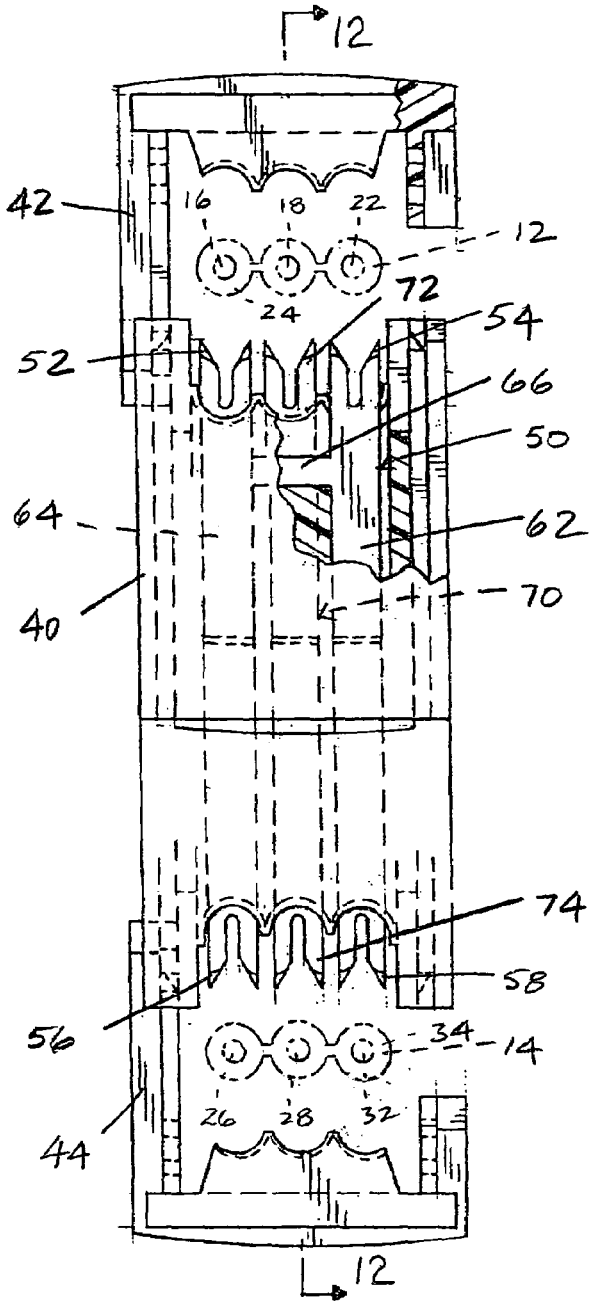
FIG. 6 is a front view, partially in cross section, of the splice connector of FIG. 1 in the open position.

In the embodiment depicted, the connector 10 is polarity insensitive. With reference to FIG. 6, two IDC terminals are provided to interconnect the first cable 12 to the second cable 14. A first IDC terminal 50 includes upper bifurcated ends 52 and 54 that engage the outer wires 16 and 22 of the first cable 12 and lower bifurcated ends 56 and 58 that engage the outer wires 26 and 32 of the second cable 14. The first IDC terminal 50 is made of a stamped metal, for example a bent tinned copper. Other materials and plating can be used, the selection of which based on compatibility with the wire conductor (for example 16, 18, 22, 26, 28, and 32) specified. A flattened L-shaped portion 62 interconnects the upper bifurcated end 54 with the lower bifurcated end 58. Similarly, a flattened L-shaped portion 64 interconnects the upper bifurcated end 52 to the lower bifurcated end 56. A connector or bridge portion 66 interconnects the first portion 62 to the second portion 64 so that the upper bifurcated ends 52 and 54 as well as the lower bifurcated ends 56 and 58 are all electrically interconnected so that either cable 12 or 14 can be rotated 90 degrees without having an effect on the electrical connection made by the splice connector 10.

Figure 12:
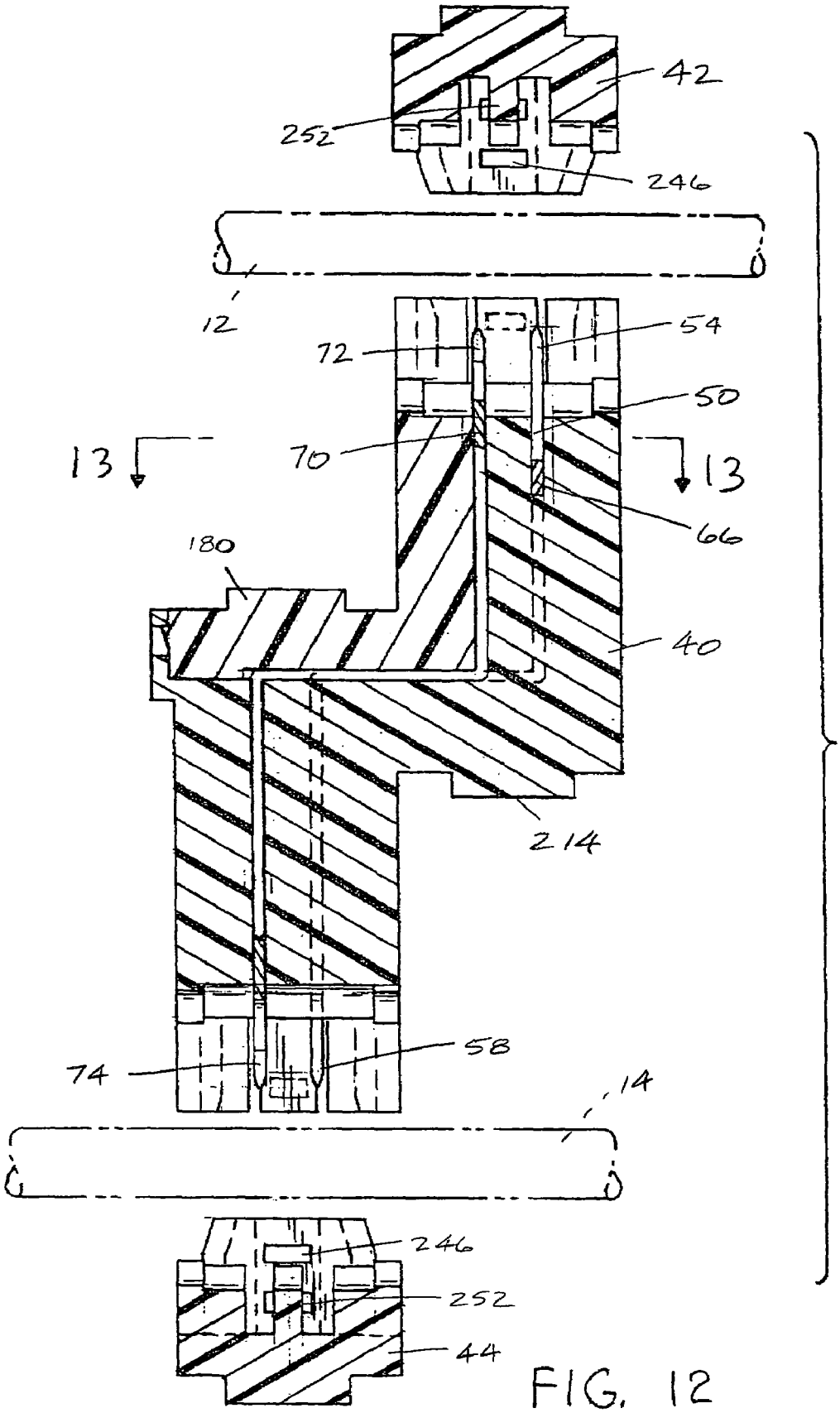
FIG. 12 is a cross-sectional view of the splice connector taken along line 12—12 of FIG. 6.
Figure 13:
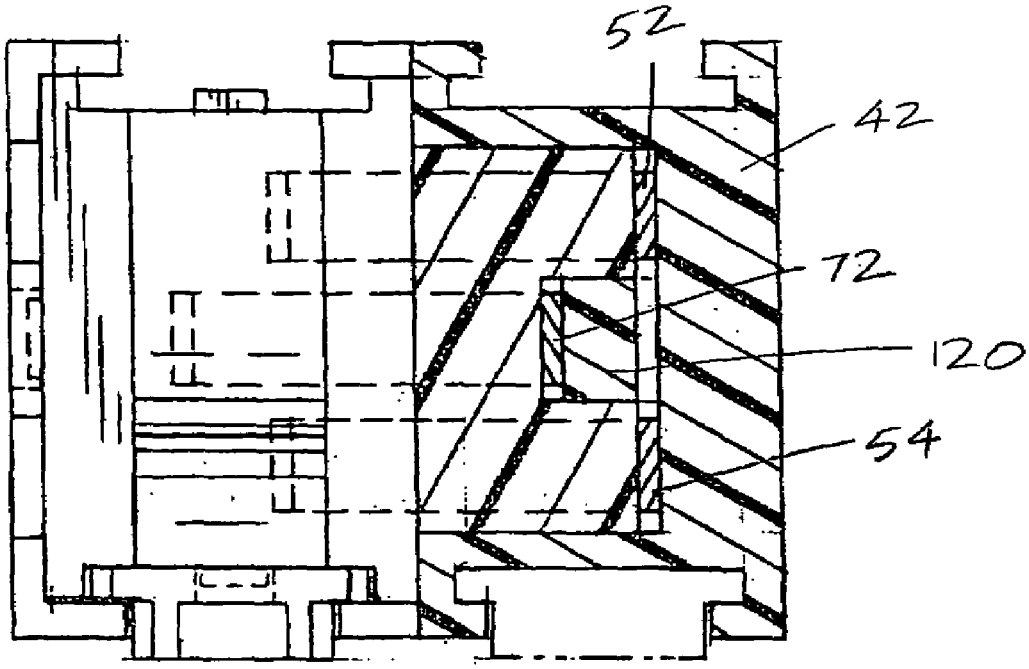
FIG. 13 is a cross-sectional view of the splice connector taken along line 13—13 of FIG. 12.

The second IDC terminal 70 is spaced from the first IDC terminal 50 and in some locations has an insulating material disposed between the two so that there is no electrical connection between the first IDC terminal 50 and the second IDC terminal 70 (see FIG. 12). The second IDC terminal 70 includes an upper bifurcated end 72 that is configured to engage the central wire 18 of the cable 12 and a lower bifurcated end 74 that is configured to engage the central wire 28 of the lower cable 14.

The IDC terminals 50 and 70 have been described as separate single piece components; however, an IDC connection can be provided in other manners. For example, the first IDC terminal 50 can be replaced with a plurality of electrically interconnected members. For instance, pointed bifurcated ends, similar to bifurcated ends 52, 54, 56 and 58, can be interconnected by an electrically conductive member. The same holds true for the second IDC terminal. Likewise, the bridge portion 66 of the first IDC terminal 50 can be replaced by an electrically conducive member.

Figure 8:
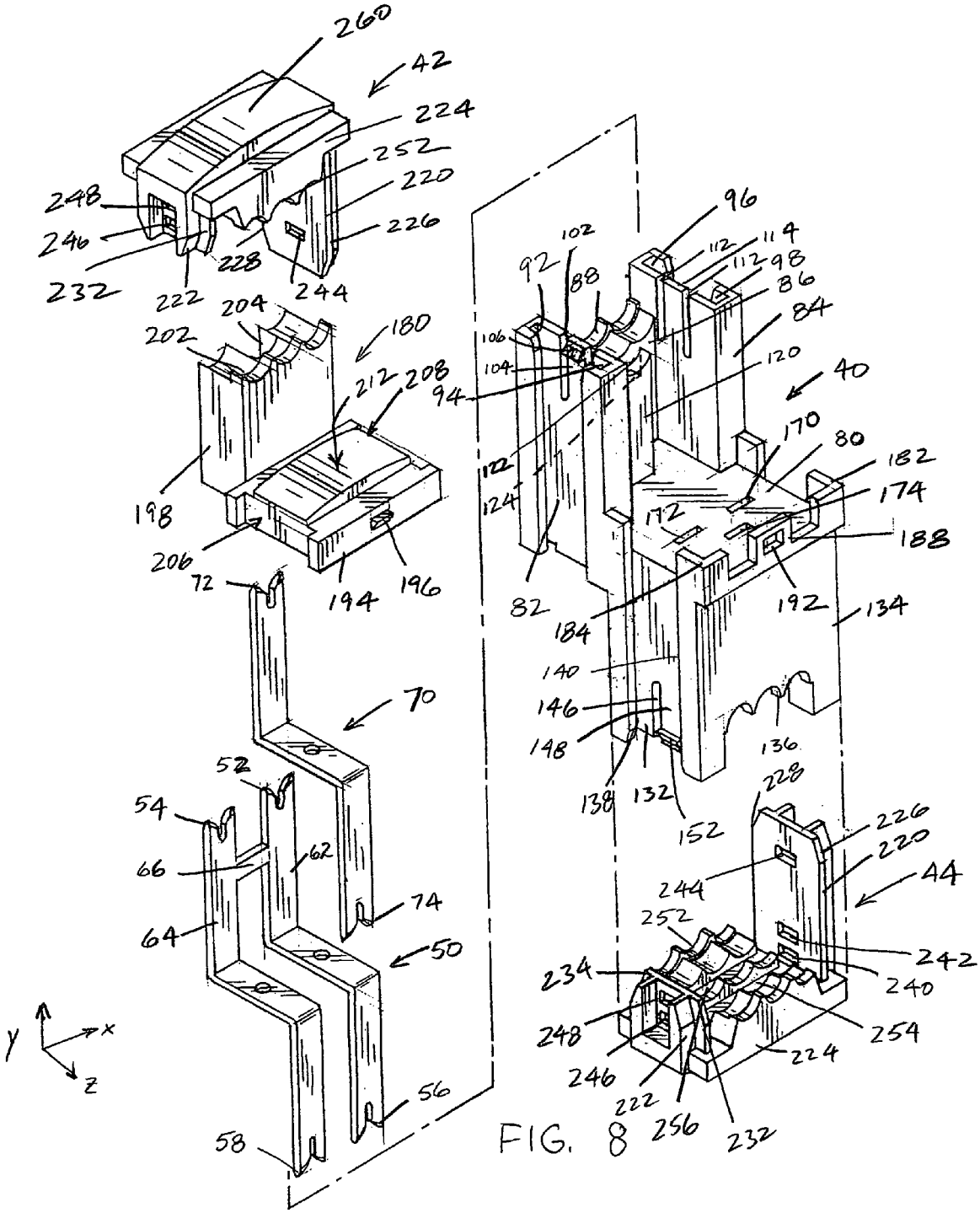
FIG. 8 is a side perspective exploded view, opposite the view of FIG. 1, of the splice connector of FIG. 1.

With reference to FIG. 8, construction of the embodiment of the connector 10 (FIG. 1) will be described to more detail. For ease of explanation only, components of the splice connector will be described with relation to three axes as depicted in FIG. 8. The splice connector can be made and assembled into many different manners and should not be limited to the exact orientations referenced herein.

In the depicted embodiment, the main body 40 is made of a single molded of plastic, or other non-conductive material. The body 40 includes a central platform 80 disposed in the X-Z plane. First and second upper tracks 82, 84 extend upwardly (in the Y-axis) from the central platform 80. The tracks 82 and 84 are spaced from one another along the X-axis and a central pedestal 86 also extends upwardly from the central platform 80 interconnecting the first upper track 82 to the second upper track 84. The central pedestal 86 includes curved upper surfaces 88 that define wire seats for receiving the upper wire 12 (FIG. 1). The first and second tracks 82 and 84 allow for selective sliding linear movement of the upper cover 42. The first track 82 defines a first channel 92 and a second channel 94 that is spaced from the first channel along the Z-axis. Similarly, the second track 84 includes a first channel 96 and a second channel 98 that are also spaced from one another along the Z-axis. The channels 92–98 cooperate with portions of the upper cover 42, in a manner that will be described in more detail below, to allow the upper cover 42 to slide in relation to the body 40. Slots 102 extend (downwardly in FIG. 8) from an upper end of the first track 82 in the direction that is parallel with the Y-axis. The slots 102 define a flexible tab 104. A ramped protuberance 106 extends from the flexible tab 104 away from the central pedestal 88 in a direction generally parallel with the X-axis. Similarly, slots 112 extend downwardly from an upper end of the second track 84 to define a flexible tab 114. A ramped protuberance 116 (FIGS. 1–3) extends outwardly from the flexible tab 114 away from the central pedestal 86 in a direction that is generally parallel to the X-axis.

A forward central pedestal 120 extends into the platform 80 from the central pedestal 86 in a direction that is generally parallel to the Z-axis. A channel 122 is disposed between the forward central pedestal 120 and the central pedestal 86. A shelf 124 is provided at the lower end of channel 122 and the bridge 66 of the first IDC terminal 50 is received inside the channel 122 and rests on the shelf 124.

The body 40 also includes first and second lower tracks 132 and 134 that depend downwardly from the platform 80 in the direction that is generally parallel to the Y-axis. The lower tracks 132 and 134 are similarly shaped to the upper tracks 82 and 84 of the main body 40. Curved surfaces 136 that define a wire seat are interposed between the tracks 132 and 134 and are shaped to receive the lower cable 14 (FIG. 1). Also, first channel 138 and second channel 140 for the first lower track 132 are similarly shaped to the channels 92 and 94 to the upper track 82. These channels cooperate with a portion of the lower cover 44 so that the lower cover can slide in relation to the main body 40 in a linear direction that is parallel to the Y-axis. Likewise, as seen in FIG. 2, the second track 134 includes a first channel 142 and a second channel 144 (FIG. 1) that are spaced from one another along the Z-axis. These channels receive a portion of the lower cover 44 in a manner to allow the lower cover to move in a linear direction along the Y-axis with respect to the body 40. Also, slots 146 are formed in the first lower track 132 (only one visible) to define a flexible tab 148. A ramped protuberance 152 extends from the flexible tab 148 away from the wire seats 136. Similarly, as seen in FIG. 1, slots 154 are formed in the second lower track 134 to define a flexible tab 156. A ramped protuberance 158 extends outwardly from the flexible tab 156 generally away from the wire seats 136.

With reference back to FIG. 8, outer openings 170 and 172, which in the depicted embodiment are rectangular, extend through the central platform 80. A central opening 174, which is also rectangular, also extends through the central platform 80. The outer openings 170 and 172 are spaced from one another along X-axis. The central opening 174 disposed between the outer openings 170 and 172 along the X-axis and is spaced from the outer openings along the Z-axis. The first outer opening 170 receives the lower portion of the first portion 62 of the first IDC terminal 50 and the second outer opening 172 receives the second portion 64 of the first IDC terminal 50. The central opening 170 receives a lower portion of the second IDC terminal 70.

Figure 7:
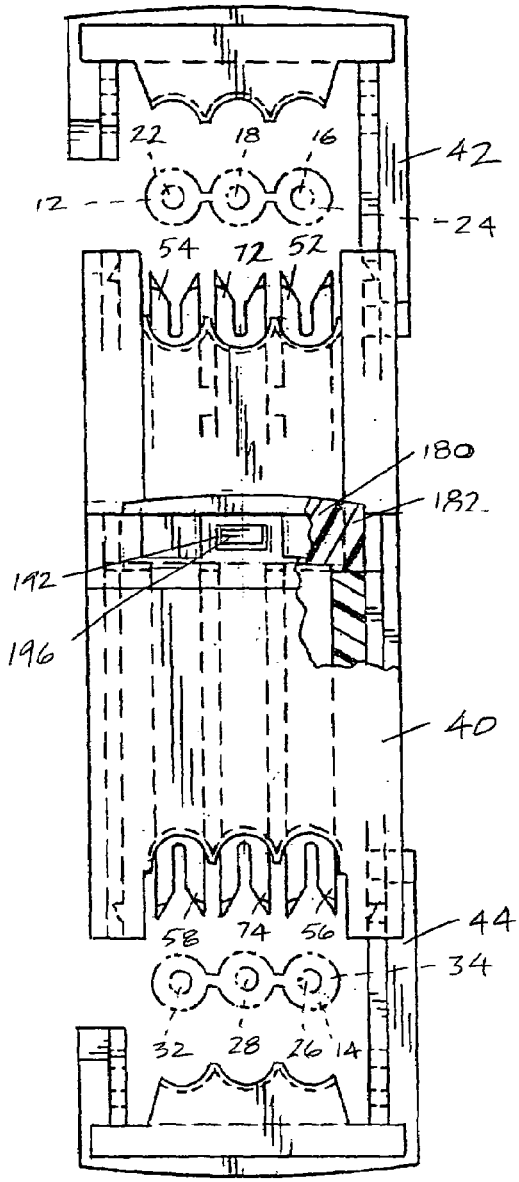
FIG. 7 is a rear view, partially in cross section, of the splice connector of FIG. 1 in the open position.

An IDC terminal cover 180 attaches to the body 40 to secure the IDC terminals 50 and 70 to the body. In the depicted embodiment, the IDC cover 180 sandwiches a portion of each terminal 50 and 70 against the platform 80 of the base 40 (see FIG. 7). The IDC cover 180 in the depicted embodiment is made of a molded plastic material, similar to the main body 40 and the covers 42 and 44. IDC cover locator walls 182 and 184 that have a generally L-shaped configuration extend upwardly from the central platform 80 of the body 40. A central locator wall 188 extends upwardly from the central platform 80 and is disposed between the locator walls 180 and 184. The central locator wall 188 includes an opening 192, which in the depicted embodiment is rectangular.

The IDC cover 180 includes a generally rectangular base 194. The rectangular base 194 is shaped to cover at least a majority of the central platform 80 of the main body 40. A ramped protuberance 196 extends from the rectangular base 194 and is configured to be received inside the opening 192 in the central wall 188 that extends upwardly from the central platform 80 of the body 40 when the IDC connector 180 is attached to the main body 40. The IDC cover 180 also includes an upwardly extending pedestal portion 198 that includes curved surfaces 202 that define portions of a wire seat. The curved portions 202 align with the curved portions 88 of the central pedestal 86 when IDC cover 180 is attached to the main body 40. A channel 204 formed in the upwardly extending pedestal portion 198 aligned with the Y-axis is formed in the rear of the pedestal 198 and is configured to receive the central forward pedestal 120 in the upper portion of the second terminal 70 when the IDC cover attaches to the main body 40.

The base 194 of the IDC terminal cover 180 also includes a first recessed surface 206 formed in the Y-Z plane and a second recessed surface 208 formed in the Y-Z plane spaced from the first recessed surface along the X-axis. The recessed surfaces 206 and 208 align with the tracks to facilitate movement of the upper and lower covers 42 and 44. The IDC cover 180 also includes a curved upper surface 212 that can facilitate attachment of the IDC cover 180 to the main body 40. The curved upper surface 212 directs the rotationally directed force of pliers toward the centerline, along the Y-axis, of the IDC cover 180. Similar to the curved upper surface 212, the base 40 includes a curved lower surface 214 (FIG. 12).

The upper cover 42 and the lower cover 44 attach to the main body 40 in such a manner that each can slide linearly along the Y-axis with respect to the main body. In the depicted embodiment, the upper cover 42 and the lower cover 44 are identical which eases assembly of the splice connector 10 as well as reducing manufacturing costs by limiting the number of different components that are to be molded. Accordingly, portions of each of the upper cover and lower cover will be described with reference to each cover where visible and only one cover where the portion is not visible on the other cover.

Each cover includes a longer appendage 220 and a shorter appendage 222 that each extend from a base 224. The appendages 220 and 222 are configured to be received in the tracks 82, 84, 132 and 134 of the main body 40. More specifically, the longer appendage 220 of the upper cover 42 is received in the second track 84 and the shorter appendage 222 of the upper cover 42 is received in the first track 82. Similarly, the longer track 20 of the lower cover 44 is received in the second lower track 134 and the shorter appendage 222 of the lower cover 44 received in the first track 132. Each appendage includes flanged edges that run along the Y-axis that are configured to be received in the channels of the respective tracks. For example, the longer appendages 220 include side flanges 226 and 228. For the upper cover the edge flanges 226 and 228 are received by the channels 96 and 98 respectively. Likewise, the flanges 226 and 228 are received by the channels 142 and 144 respectively (FIG. 1). The shorter appendages 222 also include outer flanges 232 and 234 that run along the Y-axis. These are received from the respective channels 92 and 94 and 138, 142 in a similar manner to the longer appendages.

The longer appendage includes three openings: a proximal opening 240, an intermediate opening 242, and a distal opening 244. The openings are rectangular in configuration and are configured to cooperate with the ramped protuberance 116 and 158 (FIG. 1) of the main body 40.

The shorter appendage 222 includes two openings: a proximal opening 246 and a distal opening 248. These openings are also rectangular in configuration. The proximal opening 246 is aligned with the proximal opening 240 as defined by a plane that is parallel to the X-Z plane. Likewise, the distal opening 248 and the intermediate opening 242 also reside in a plane that is parallel to the X-Z plane offset from the proximal openings.

Each cover also includes a wire seat 252 that comprises a plurality of curved surfaces that are configured to receive the cables 12 and 14 (FIG. 1). The wire seat 252 includes a first channel 254 and a second channel 256 that is spaced from the first channel along the Z-axis. The channels 254 and 256 are configured to receive the distal ends of respective IDC terminals 50 and 70 as the covers 42 and 44 are pressed into the closed position.

Each cover 42 and 44 (only visible in FIG. 8 for upper cover 42) includes a curved surface to 260. The rounded or curved surface 260 facilitates easy use of a hand tool, for example pliers by directing the force imposed toward the center, e.g. aligned along the Y-axis, of the spliced connector 10 to aid in eliminating unbalanced forced vectors during termination of the wires of the cables.

Figure 9:
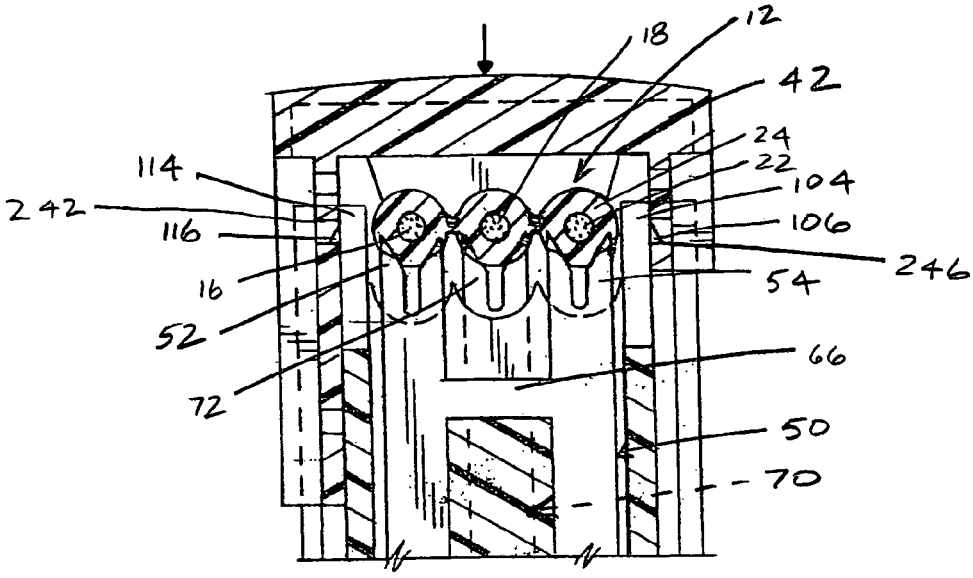
FIG. 9 is a cross-sectional view of the splice connector taken along line 9—9 in FIG. 2.

The splice connector 10 as shown in the figures allows for a staged connection between two wires. With reference back to FIG. 1, with the splice connector 10 in the open position the upper cover 42 and the lower cover 44 are spaced from the body 40 such that wires can be easily installed from the side of the body and placed in between the respective covers and the body. As also seen in FIG. 4, the open position, the ramped protuberances 116 and 158 are received in the respective distal openings 244 of the respective covers 42 and 44, thus inhibiting movement of the respective covers away from the body 40 while allowing movement of the respective covers toward the body. With reference to FIG. 2, each of the covers 42 and 44 can be partially closed or staged simply by hand as opposed to requiring the need for hand tools. As more clearly seen in FIG. 9, when the splice connector 10 is moved into the partially closed position, the bifurcated ends, for example bifurcated ends 52, 54, and 72 shown in FIG. 9, pierce the insulating cover 24 of the cable 12 but no electrical connection is made between the wires and the IDC connectors. Nevertheless, an electrical connection can be made if the covers 42 or 44 or the body 40 were slightly reconfigured. Also, as the upper cover 42 is pressed toward the main body 40, the ramped protuberance 116 (visible in FIG. 8) is received in the distal opening 246 of the shorter appendage 222 and the ramped protuberance 116 formed on the flexible tab 114 of the body 40 is received in the intermediate opening to 242 of the longer appendage 220. Accordingly, the cover 240 is limited from movement away from the body in the Y-axis once the cover 40 is pressed into the partially closed position. The same is true for the lower cover 44.

With reference to FIG. 3, the upper cover 42 and the lower cover 44 are further pressed towards the body 40 to fully close the splice connector 10 so that the wires of the cables are in electrical communication with one another. As more clearly seen in FIG. 11, as the upper cover 42 is pressed toward the body 40 the ramped protuberances 106 and 116 are received in the respective proximal openings 240 and 248 so that movement of the upper cover 42 away from the body is inhibited. Furthermore, as the upper cover 42 is pressed towards the body 40 the bifurcated ends 52, 54 and 72 further puncture the insulative material 24 for the upper cable 12 so that an electrical connection is made between the IDC connectors 50 and 70 and the respective wires. The same holds true for the lower cover 44.

The aforementioned connector 10 includes two ratchet action sliding covers 42 and 44. As described above, the covers 42 and 44 include the female portion of the connection between the body 40 and the respective covers and the body includes the male portion of the connection. Alternatively, the male portion of the connection can be provided on the cover, e.g. the cover can include a ramped protuberance that is received in separate openings formed in the body.

Figure 10:
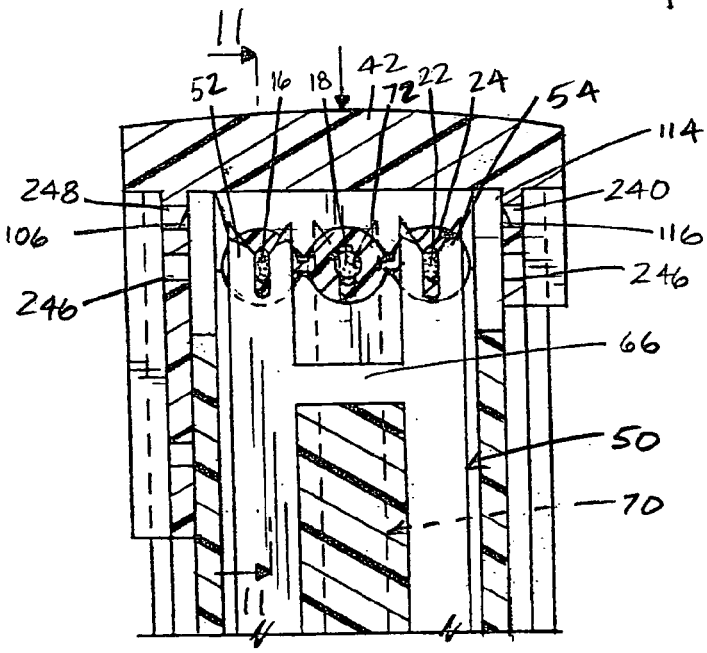
FIG. 10 is a cross-sectional view of the splice connector taken along line 10—10 of FIG. 3.
Figure 11:
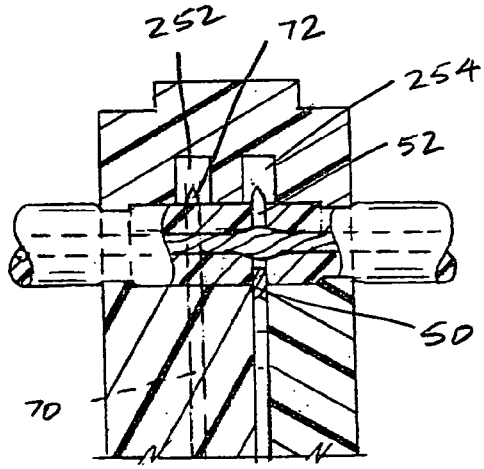
FIG. 11 is a cross-sectional view of the splice connector taken along line 11—11 of FIG. 10.

As mentioned above, the splice connector 10 is polarity insensitive. Typically for a series/parallel electrical configuration, three wires are provided: a positive wire, a negative wire, and a neutral wire. As seen in FIG. 10, the first IDC terminal 50 is spaced from the second IDC terminal and separated from one another by an electrical insulative material. As seen in FIG. 11, the bifurcated end 72 of the second IDC terminal 70 is spaced from the bifurcated end 52 of the IDC terminal 50 along an axis that is parallel to the Z-axis (FIG. 8). Furthermore, it does not matter which wire 16 or 24 of the first cable 12 is positive since an electrical connection is provided by the first bifurcated end 52 and the second bifurcated end 54 via the bridge portion 66. Accordingly, a technician need not worry about the orientation of the wire during splicing of the wire.

The splice connector 10 can achieve polarity insensitivity in other manners than providing only two IDC connectors 50 and 70 that have been described above. For example, the bifurcated ends 52, 54, 56, 58, 72 and 74 can be separate electrically conductive members that are in electrical communication with one another in a similar manner to the aforementioned IDC connectors. Similarly, the bridge 66 can be provided as a separate electrically conductive member that contacts two separate IDC connectors to provide an electrical connection between the two.

A splice connector has been described with reference to one embodiment and alternatives of that embodiment have also been disclosed. Nevertheless, the invention is not limited to the disclosed embodiment and the disclosed alternatives. Instead, the invention is to be broadly construed to include all embodiments covered the appended claims and the equivalents thereof.

The invention claimed is:

1. A splice connector comprising:

a first IDC terminal;

a second IDC terminal;

a non-conductive body in which the first and second IDC terminals are received, the non-conductive body including a first side wall having first channels extending from outside of the first side wall and a first tab and a second side wall having second channels extending from an outside of the second side wall and a second tab, the body defining a first seat configured to receive an associated first cable and a second seat configured to receive an associated second cable that is to be electrically connected to the first cable, the first and second IDC terminals each including a portion that extends into a region adjacent a respective wire seat, wherein the seats are offset from one another;

a non-conductive cover connected to the non-conductive body such that the non conductive cover can slide with respect to the non-conductive body, the non-conductive cover and the non-conductive body cooperating with one another in a manner such that movement of the cover with respect to the body in a first direction for a predetermined distance results in an engagement between the cover and the body such that movement of the cover is limited in a second direction that is opposite the first direction, the cover including a long appendage and a short appendage spaced from the long appendage each received in respective channels, the long appendage including a first opening, a second opening, and a third opening, the short appendage including a fourth opening and a fifth opening, the first opening engaging the first tab at a first position, the second opening engaging the first tab and the fourth opening engaging the second tab at a second position, and the third opening engaging the first tab and the fifth opening engaging the second tab at a third position.

2. The splice connector of claim 1, further comprising an additional cover, the additional cover connected to the body such that the additional cover can slide with respect to the body in a first linear direction from an open position to a closed position, the additional cover being configured to cooperate with the body where a portion of the additional cover engages a portion of the body at a staged position between an open position and a closed position such that in the staged position movement of the additional cover with respect to body in a second direction, which is opposite the first, is inhibited.

3. The splice connector of claim 1, wherein in the first position the cover is spaced from the body to define an open area to receive the associated first cable by inserting the associated first cable through the open area in a direction that is at least generally perpendicular to a greatest dimension of the first cable.

4. The splice connector of claim 1, wherein the cover and the base each include a curved surface configured to facilitate easy use of a hand tool to move from the third position toward the second position.

5. The splice connector of claim 1, wherein first seat is configured to receive an associated first cable having a first conductor wire, a second conductor wire, and a third conductor wire, wherein in the second position the first IDC connector contacts the first conductor wire and the third conductor wire and the second IDC connector contacts the second conductor wire.

6. The splice connector of claim 1, further comprising an IDC cover that sandwiches a portion of each IDC terminal between a portion of the IDC cover and the body.

7. The splice connector of claim 1 in combination with a string light engine, the splice connector electrically connecting a cable that provides electrical energy to light sources for the string light engine to another electrical cable.

8. A splice connector for electrically connecting at least two cables, the connector comprising:

a non-conductive body including first and second side walls each having channels extending from outside of the first and second side walls, a first seat and a second seat, the first seat being configured to receive an associated first insulated cable, the second seat being configured to receive an associated second insulated cable, each of the associated cables having a plurality of wires, wherein the seats are offset from one another;

a first electrically conductive member disposed in the body and being configured to pierce insulation to contact a first wire of the associated first cable;

a second electrically conductive member disposed in the body and being configured to pierce insulation to contact a second wire of the associated first cable;

a third electrically conductive member disposed in the body and being configured to pierce insulation to contact a third wire of the associated first cable;

a electrically conductive bridge member directly contacting the first electrically conductive member and the third electrically conductive member;

a fifth electrically conductive member disposed in the body and in electrical communication with the first electrically conductive member, the fifth electrically conductive member being configured to pierce insulation to contact a first wire of the associated second cable;

a sixth electrically conductive member disposed in the body and in electrical communication with the second electrically conductive member, the sixth electrically conductive member being configured to pierce insulation to contact a second wire of the associated second cable;

a seventh electrically conductive member disposed in the body and in electrical communication with the third electrically conductive member, the sixth seventh electrically conductive member being configured to pierce insulation to contact a third wire of the associated second cable;

a first cover having appendages slidably engaged in the channels and attached to the body, the first cover being moveable to selectively cover at least a portion of the first seat; and a second cover having appendages slidably engaged in the channels and attached to the body, the second cover being moveable to selectively cover at least a portion of the second seat.

9. The splice connector of claim 8, wherein the first member, the third member and the bridge member are formed from a single piece of electrically conductive material.

10. The splice connector of claim 8, wherein the first member, the third member, the bridge member, the fifth member and the seventh member are formed from a single piece of electrically conductive material.

11. The splice connector of claim 10, wherein the second member and the sixth member are formed from a single piece of electrically conductive material.

12. The splice connector of claim 8, wherein the first cover mechanically engages the body in at least three distinct locations, wherein at each location movement of the first cover away from the body is inhibited.

13. The splice connector of claim 12, wherein the second cover mechanically engages the body in at least three distinct locations, wherein at each location movement of the second cover away from the body is inhibited.

* * * * *

UNITED STATES PATENT AND TRADEMARK OFFICE

CERTIFICATE OF CORRECTION

PATENT NO. : 7,156,686 B1
APPLICATION NO. : 11/318744
DATED : January 2, 2007
INVENTOR(S) : William Sekela et al.

It is certified that error appears in the above-identified patent and that said Letters Patent is hereby corrected as shown below:

Column 10, line 25, delete the word “sixth”.

Signed and Sealed this

Twenty-seventh Day of February, 2007

JON W. DUDAS
*Director of the United States Patent and Trademark Office*